US007086888B2

(12) United States Patent
Wu

(10) Patent No.: US 7,086,888 B2
(45) Date of Patent: Aug. 8, 2006

(54) SERIAL ATA CABLE ASSEMBLY WITH SMALL SIZE

(75) Inventor: Jerry Wu, Irvine, CA (US)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 10/911,448

(22) Filed: Aug. 3, 2004

(65) Prior Publication Data

US 2006/0030215 A1 Feb. 9, 2006

(51) Int. Cl.
*H01R 13/627* (2006.01)

(52) U.S. Cl. ..... 439/358; 439/108; 439/610

(58) Field of Classification Search ..... 439/357–358, 439/638, 108, 79, 610
See application file for complete search history.

(56) References Cited

U.S. PATENT DOCUMENTS 3,760,335 A * 9/1973 Roberts ..... 439/398
5,934,942 A * 8/1999 Patel et al. ..... 439/610
6,231,355 B1 * 5/2001 Trammel et al. ..... 439/79
6,585,536 B1 * 7/2003 Wu ..... 439/358
6,585,537 B1 * 7/2003 Lee ..... 439/358
6,695,641 B1 * 2/2004 Lee ..... 439/493
6,746,255 B1 6/2004 Lee et al. ..... 439/108
6,824,426 B1 * 11/2004 Spink, Jr. ..... 439/579

* cited by examiner

*Primary Examiner*—Michael C. Zarroli
(74) *Attorney, Agent, or Firm*—Wei Te Chung

(57) ABSTRACT

A Serial ATA cable assembly (1000) having a small size includes an housing (1), upper and lower rows of contacts (2), a contact spacer (3), a number of standard Serial ATA cables (4) arranged in two rows, a cable spacer (5) defining two rows of receiving cavities for receiving corresponding cables, a cover (6) over-molding a rear portion of the housing, a front portion of the cables and the cable spacer, and a locking member (7) assembled onto the housing and the cover. The housing includes an upper wall (10), an opposite bottom wall (11) and a pair of sidewalls (12) connecting with the upper and the bottom walls. The walls together define an L-shaped receiving space (13). The upper and the bottom walls each defines a row of passageways for receiving the upper and the lower rows of contacts.

13 Claims, 8 Drawing Sheets

SERIAL ATA CABLE ASSEMBLY WITH SMALL SIZE

BACKGROUND OF THE INVENTION

1. Field of the Invention

The present invention generally relates to a cable assembly, and more particularly to a Serial ATA cable assembly with small size.

2. Description of Related Art

Currently, Serial Advanced Technology Attachment (Serial ATA) connectors are only single position seven pin connectors. Today, not only are processor speeds increasing, but the amount of space that a computer fits into is shrinking. Therefore, the motherboards or printed circuit boards (PCBs) that hold the electronics and other devices for a computer have limited space. In a computer which may contain multiple hard drives, multiple Serial ATA connectors and Serial ATA cable assemblies may need to reside on the printed circuit board and occupy the space of the computer. This takes up considerable space, depending on the number of hard disk drives and associated Serial ATA connectors.

Therefore, there is a need for integrating overall Serial ATA connector interfaces into one interface that saves computer space and simplifies the assembly and manufacturing of the Serial ATA connector. U.S. Pat. No. 6,746,255 B1 discloses such a Serial ATA cable assembly. The Serial ATA cable assembly includes an insulative housing defining a plurality of passageways, a plurality of contacts retained in the insulative housing, a plurality of standard Serial ATA cables and a plurality of single wires located between two standard Serial ATA cables. However, the passageways are only defined in a longitudinal wall of the insulative housing, and the plurality of standard Serial ATA cables and single wires are arranged in a side-by-side so that the Serial ATA cable assembly has a relatively long length in a longitudinal direction, thus the cable assembly will still occupy larger valuable space in the motherboard.

Hence, it is desired to provide an improved cable assembly to avoid the foregoing drawbacks.

SUMMARY OF THE INVENTION

A main object of the present invention is to provide a cable assembly having a small size and a simple structure.

In order to achieve the objects set forth, a cable assembly in accordance with the present invention comprises an insulative housing, upper and lower rows of contacts, a contact spacer, a plurality of standard Serial ATA cables arranged in two rows, a cable spacer defining two rows of receiving cavities for receiving corresponding cables, a cover over-molded a rear portion of the housing, a front portion of the cables and the cable spacer, and a locking member assembled onto the housing and the cover. The insulative housing comprising an upper wall, an opposite bottom wall and a pair of sidewalls connecting with the upper and the bottom walls. The walls together define an L-shaped receiving space. The upper and the bottom walls each defines a row of passageways extending therethrough along a front-to-back direction for receiving the upper and the lower rows of contacts.

Other objects, advantages and novel features of the invention will become more apparent from the following detailed description when taken in conjunction with the accompanying drawings.

DETAILED DESCRIPTION OF THE INVENTION

Figure 1:
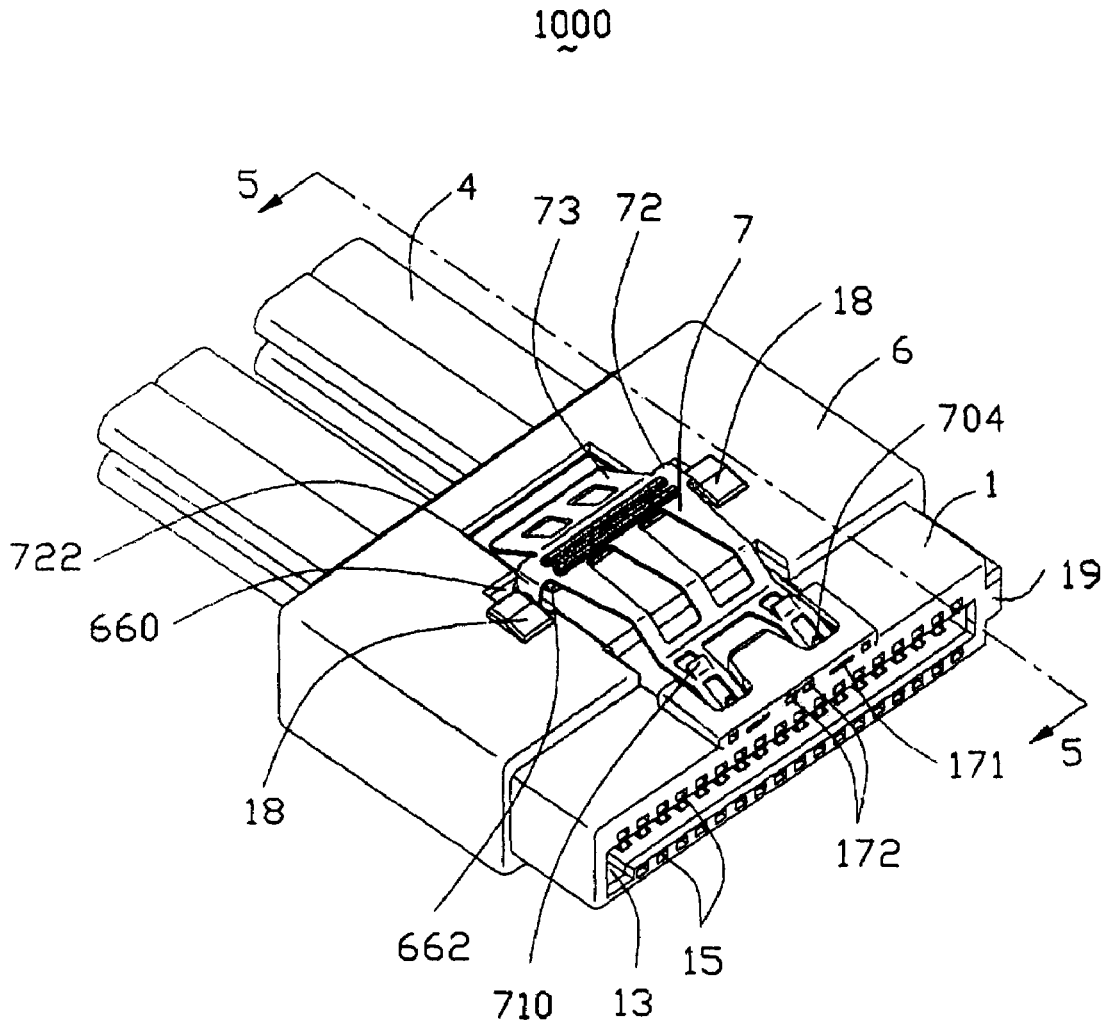
FIG. 1 is an assembled, perspective view of a cable assembly in accordance with the present invention.
Figure 2:
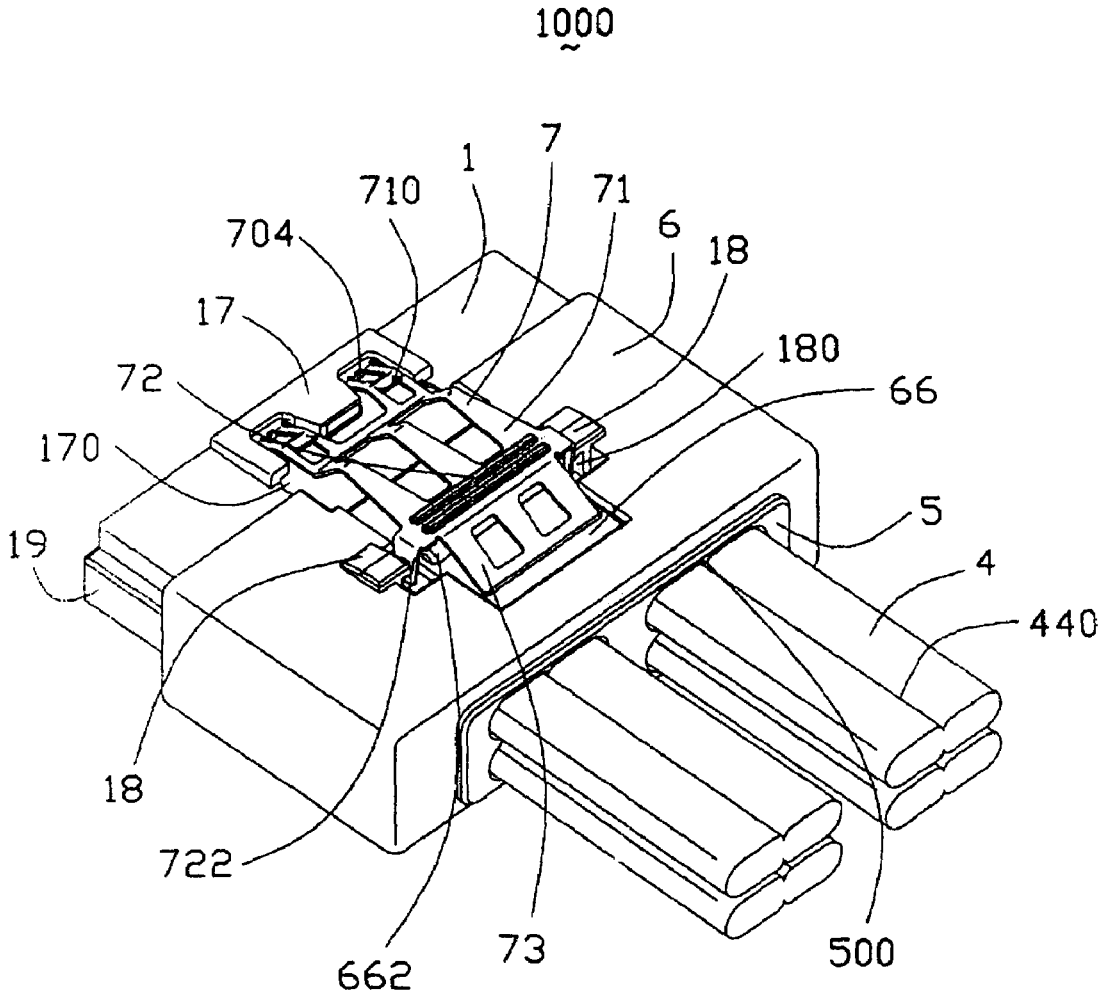
FIG. 2 is a view similar to FIG. 1, but taken from a rear aspect.

Reference will now be made in detail to the preferred embodiment of the present invention.

Referring to FIGS. 1–4, a cable assembly 1000 in accordance with the present invention comprises an insulative housing 1, upper and lower rows of conductive contacts 2, a contact spacer 3, a plurality of standard Serial ATA cables 4 arranged in two rows, a cable spacer 5 attached to the cables 4, a cover 6 and a locking member 7 for locking with a complementary connector (not shown).

Figure 3:
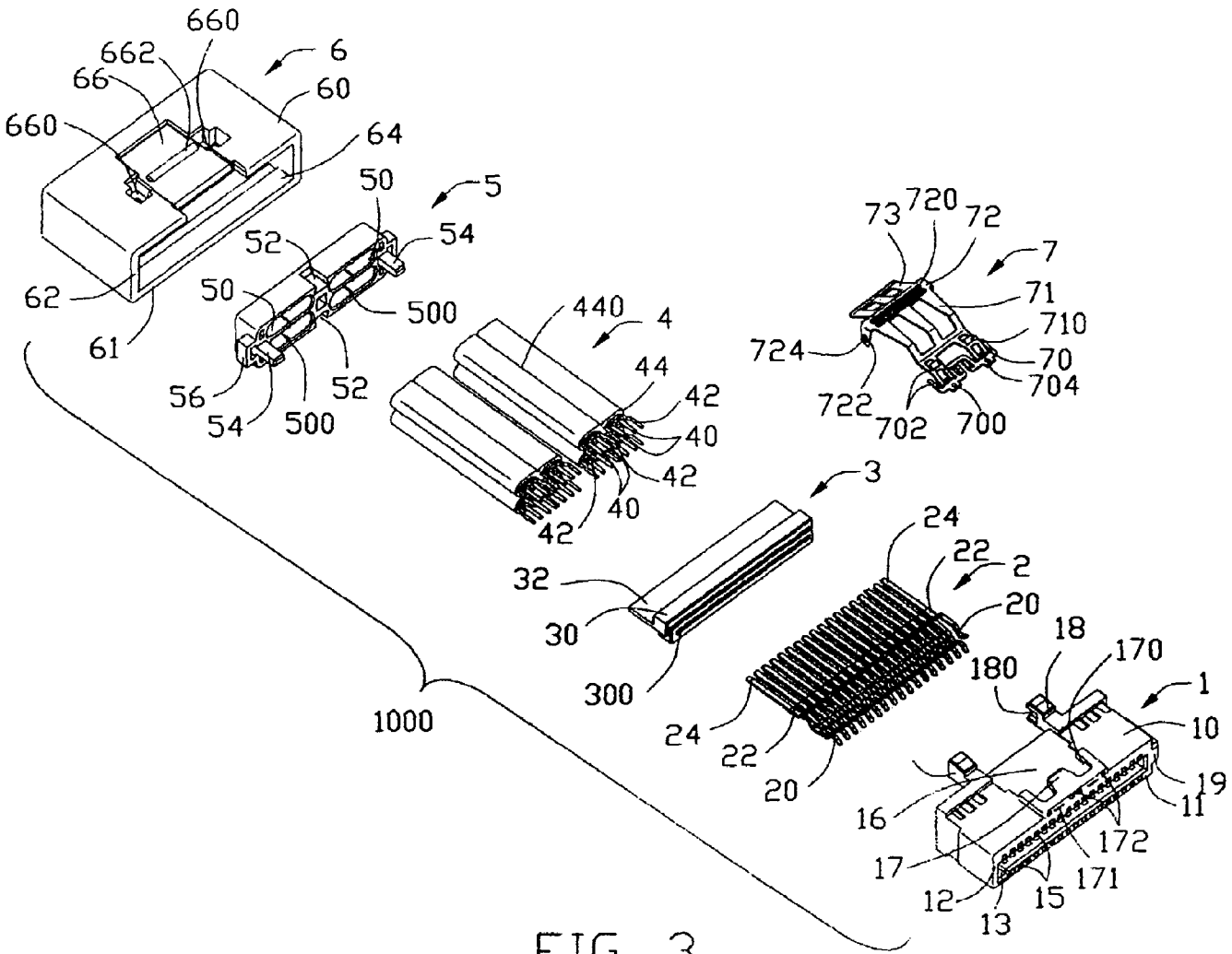
FIG. 3 is an exploded, perspective view of the cable assembly of FIG. 1.
Figure 4:
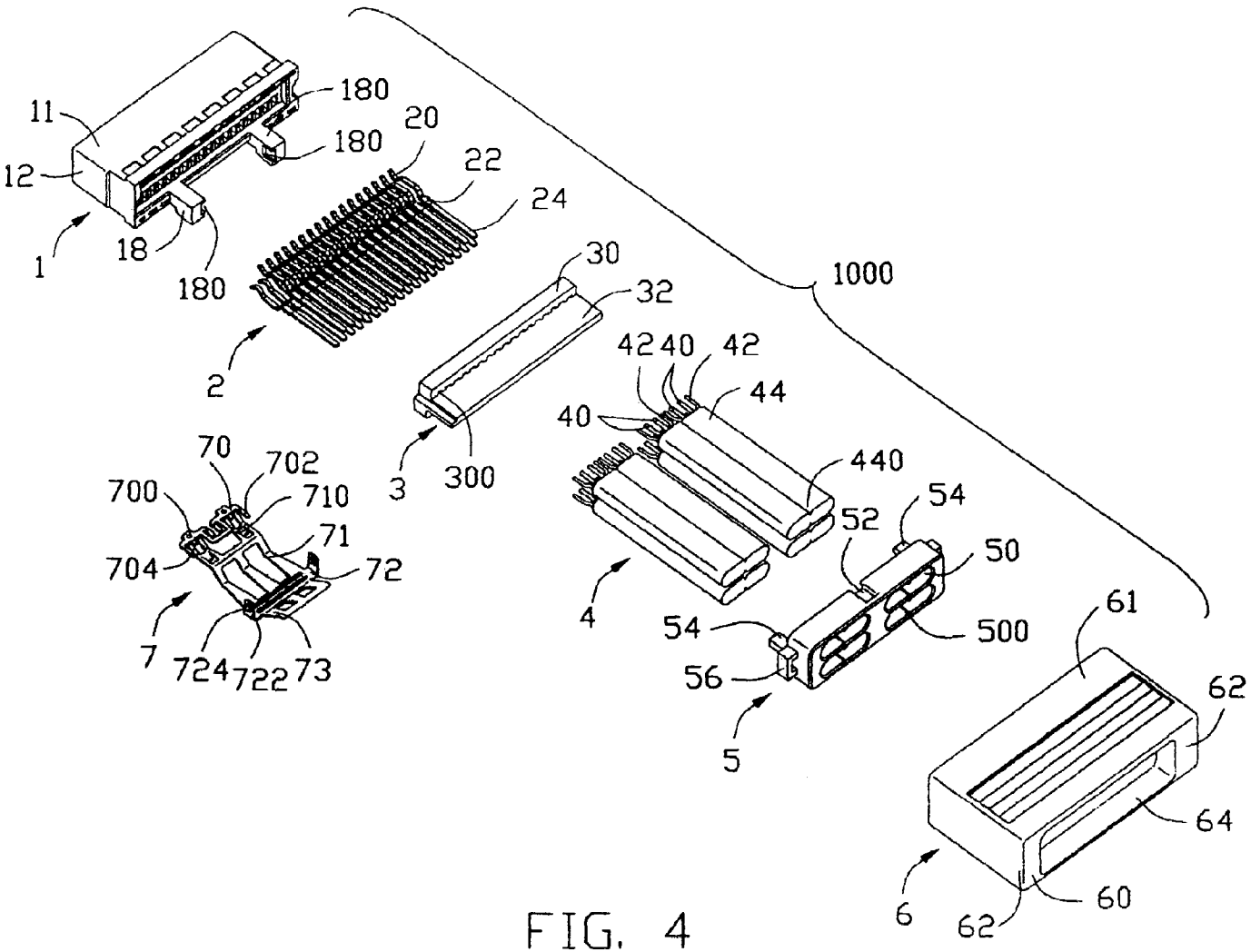
FIG. 4 is a view similar to FIG. 3, but taken from rear and bottom aspects.

Referring to FIGS. 3 and 4, the insulative housing 1 comprises an upper wall 10, a lower wall 11 opposite to the upper wall 10, a pair of sidewalls 12 connecting with the upper wall 10 and the lower wall 11. The upper wall 10, the lower wall 11 and the sidewalls 12 together define an L-shaped receiving space 13 therebetween. The upper and the lower walls 10, 11 each define a row of passageways 15 extending therethrough along a front-to-back direction. The upper wall 11 defines a depression 16 in an upper surface thereof. A flat portion 17 protrudes upwardly and rearwardly from a middle portion of a front flange of the upper wall 10 into the depression 16. A gap 170 is formed between the flat portion 17 and a bottom surface of the depression 16. The upper wall 10 further defines a pair of first slots 171 and two pairs of second slots 172 in communication with the gap 170. A pair of wing portions 18 each extend rearwardly along the upper wall 10 from a rear wall (not labeled) of the housing 1. Each wing portion 18 defines a cutout 180 in a rear portion thereof. A block 19 is integrally formed on one sidewall 12 of the housing 1 for providing blind mating function.

Each contact 2 comprises a curved contact portion 20 at a free end thereof exposed in a corresponding passageway 15 of the insulative housing 1, a retention portion 22 at a middle thereof, and a tail portion 24 extending rearwardly from the retention portion 22.

The contact spacer 3 comprises a stop block 30 received in a space (not labeled) of a rear portion of the insulative housing 1 and defining upper and lower rows of through holes 300 for respectively allowing the tail portions 24 of the upper and the lower rows of contacts 2 to pass therethrough, and a base plate 32 extending rearwardly from the stop block 30 between the upper and the lower rows of through holes 300 for supporting the tail portions 24 of the contacts 2. The stop block 30 of the contact spacer 3 can prevent plastic from entering into the passageways 15 of the insulative housing 1 during the over-molding of the cover 6.

Each standard Serial ATA cable 4 comprises two differential conductor pairs 40, two pairs of grounding conductors 42 each arranged at opposite sides of the differential conductor pair 40, and an outer jacket 44 enclosing the differential conductor pairs 40 and the grounding conductors 42. Additionally, each standard Serial ATA cable 4 defines a pair of channels 440 in middle portions of two opposite flat sides of the outer jacket 44 along a lengthwise direction.

The cable spacer 5 defines an upper and a lower rows of receiving cavities 50 along a front-to-back direction for allowing the cables 4 to extend therethrough. A pair of position ribs 500 are formed in top and bottom walls of each receiving cavity 50. The cable spacer 5 has a pair of stopping posts 54 extending forwardly from two opposite longitudinal ends of a front portion thereof for bearing against the base plate 32 of the contact spacer 3 to prevent the cable spacer 5 from further moving forwardly during over-molding. Additionally, the cable spacer 5 provides a pair of dovetail grooves 52 in middle portions of top and bottom walls thereof, and a pair of ear portions 56 projecting outwardly from two opposite sides thereof and adjacent to the stopping posts 54 for conveniently engaging with the cover 6.

The cover 6 comprises a top wall 60, an opposite bottom wall 61, a pair of side walls 62 connecting with the top wall 60 and the bottom wall 61. A receiving chamber 64 is defined between the top and the bottom walls 60, 61 for receiving the rear portion of the insulative housing 1 and the cable spacer 5. The top wall 60 defines a recess 66 in an upper surface thereof in a position corresponding to the depression 16 of the housing 1. A pair of passages 660 are defined at opposite sides of the recess 66 in communication with the receiving cavity 64. The top wall 60 comprises a pivot portion 662 located between the two passages 660.

The locking member 7 is stamped and formed from a metallic plate and comprises a retaining portion 70, a locking portion 71 extending upwardly and rearwardly from the retaining portion 70, a pressing portion 72 extending rearwardly from the locking portion 71, and a supporting portion 73 extending rearwardly and downwardly from the pressing portion 72. The retaining portion 70 has a pair of forwardly extending positioning tabs 700, two pairs of snap tabs 702 extending rearwardly and upwardly from a front end thereof, and a pair of upwardly protruding curved stopping portions 704. The locking portion 71 has a pair of latch tabs 710 protruding upwardly and rearwardly therefrom for locking with the complementary connector. The pressing portion 72 comprises a body section 720 forming a plurality of ribs (not labeled) for facilitating handling and a pair of side beams 722 extending downwardly from opposite lateral ends of the body section 720. Each side beam 722 is stamped with a spring tab 724 extending outwardly therefrom. The pressing portion 72 is downwardly movable relative to a rear portion of the cover 6 to deflect the locking portion 71 toward the cover 6 and the insulative housing 1. The supporting portion 73 is located in the recess 66 of the cover 6 with a bottom edge abutting against a bottom surface of the recess 66. The stopping portions 704 can prevent the locking portion 71 from excessively deflecting toward the cover 6 and the insulative housing 1.

Figure 5:
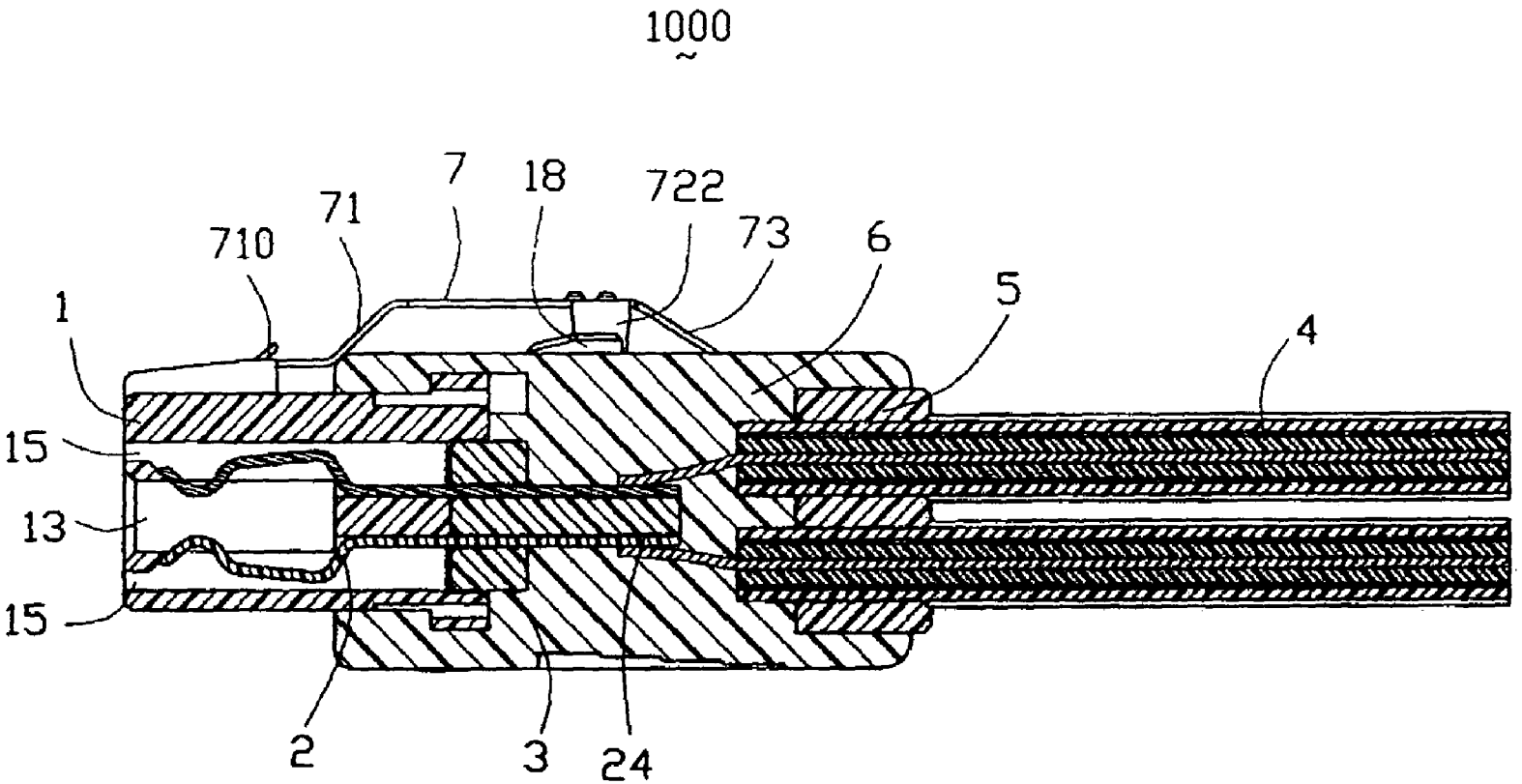
FIG. 5 is a cross-sectional view of the cable assembly taken along line 5—5 of FIG. 1.

Referring to FIGS. 1–4 in conjunction with FIG. 5, in assembly, the conductors 40, 42 of the cables 44 are respectively soldered to corresponding tail portions 24 of the contacts 2. The cable spacer 5 is attached to the cables 4 in a back-to-front direction with the position ribs 500 engaging with the channels 440. The rear portion of the insulative housing 1, the joint portions between the contacts 2 and the cables 4, and the cable spacer 5 are over-molded by the cover 6. The wing portions 18 are partially exposed beyond the passages 660 of the cover 6. The locking member 7 is assembled onto the insulative housing 1 and the cover 6 with the spring tabs 724 of the side beam 722 being received in the cutouts 180 of the wing portions 18, and the positioning tabs 700 and the snap tabs 702 being respectively received in the first and the second slots 171, 172 of the insulative housing 1.

Figure 6:
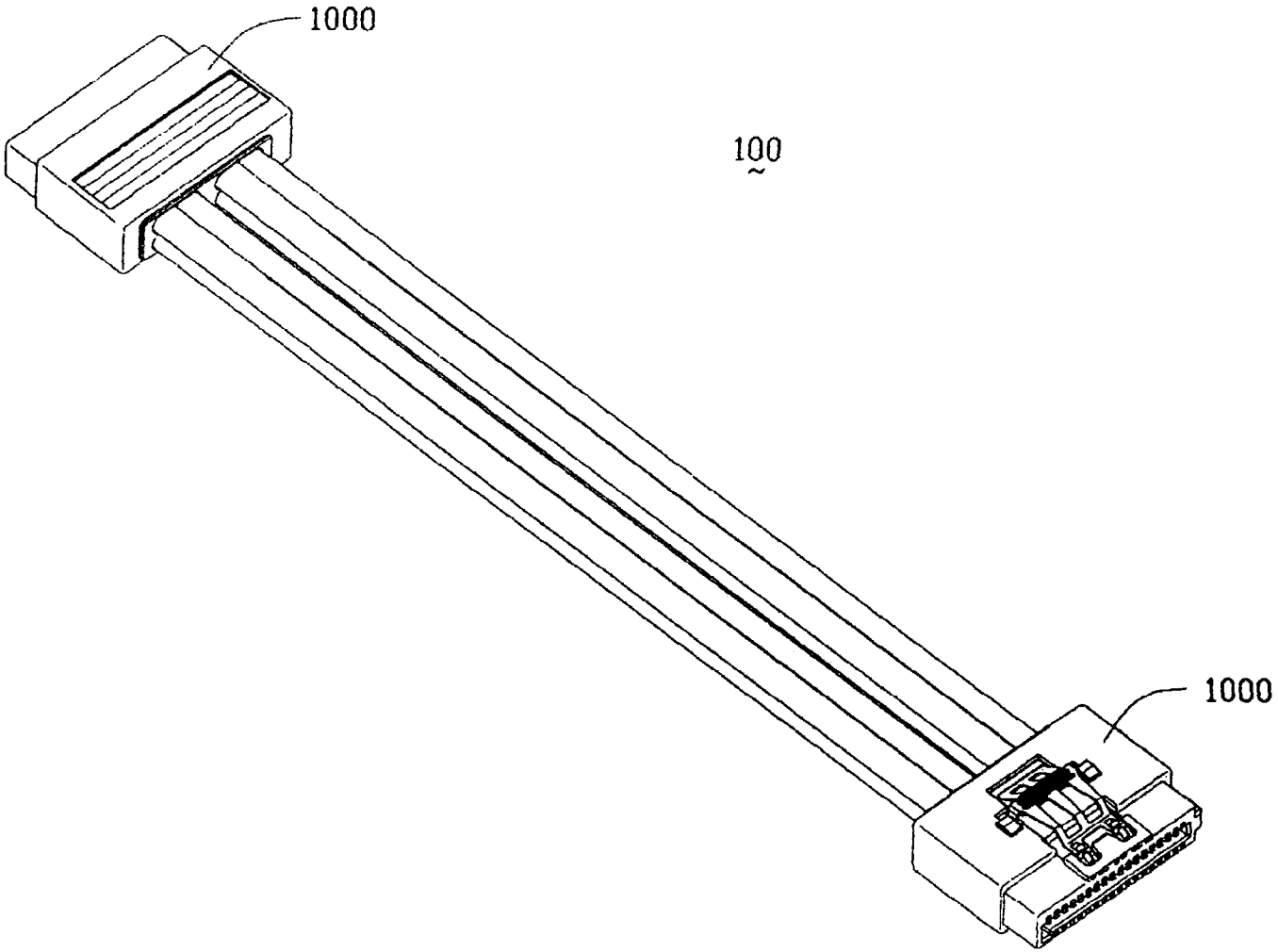
FIG. 6 is an assembled, perspective view of the cable assembly in accordance with the present invention forming a cable assembly system.

FIG. 6 illustrates a first embodiment of a cable assembly system 100 having a pair of cable assemblies 1000 according to the present invention in two ends of a set of cables.

Figure 7:
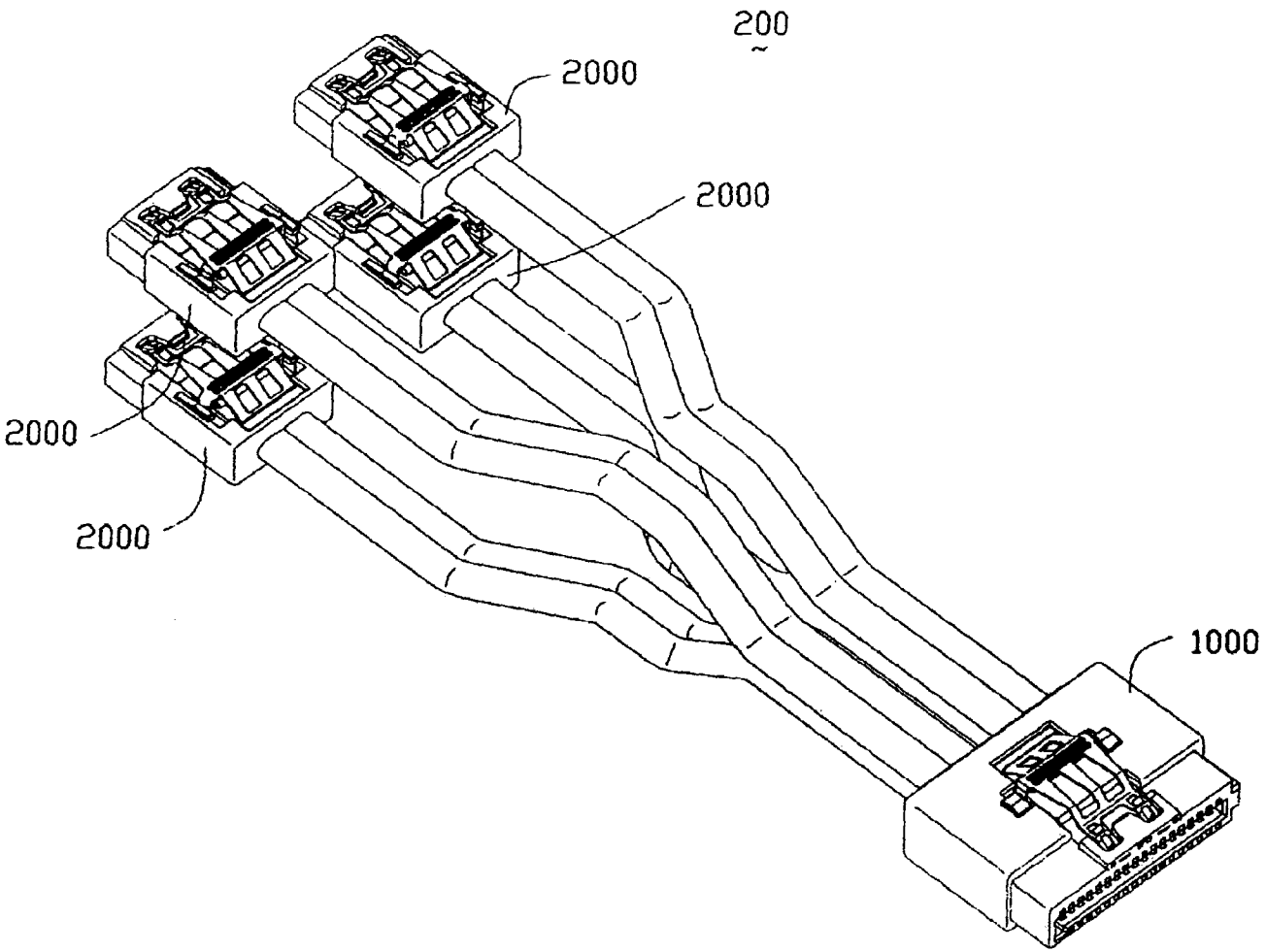
FIG. 7 is an assembled, perspective view of the cable assembly in accordance with the present invention forming another cable assembly system.
Figure 8:
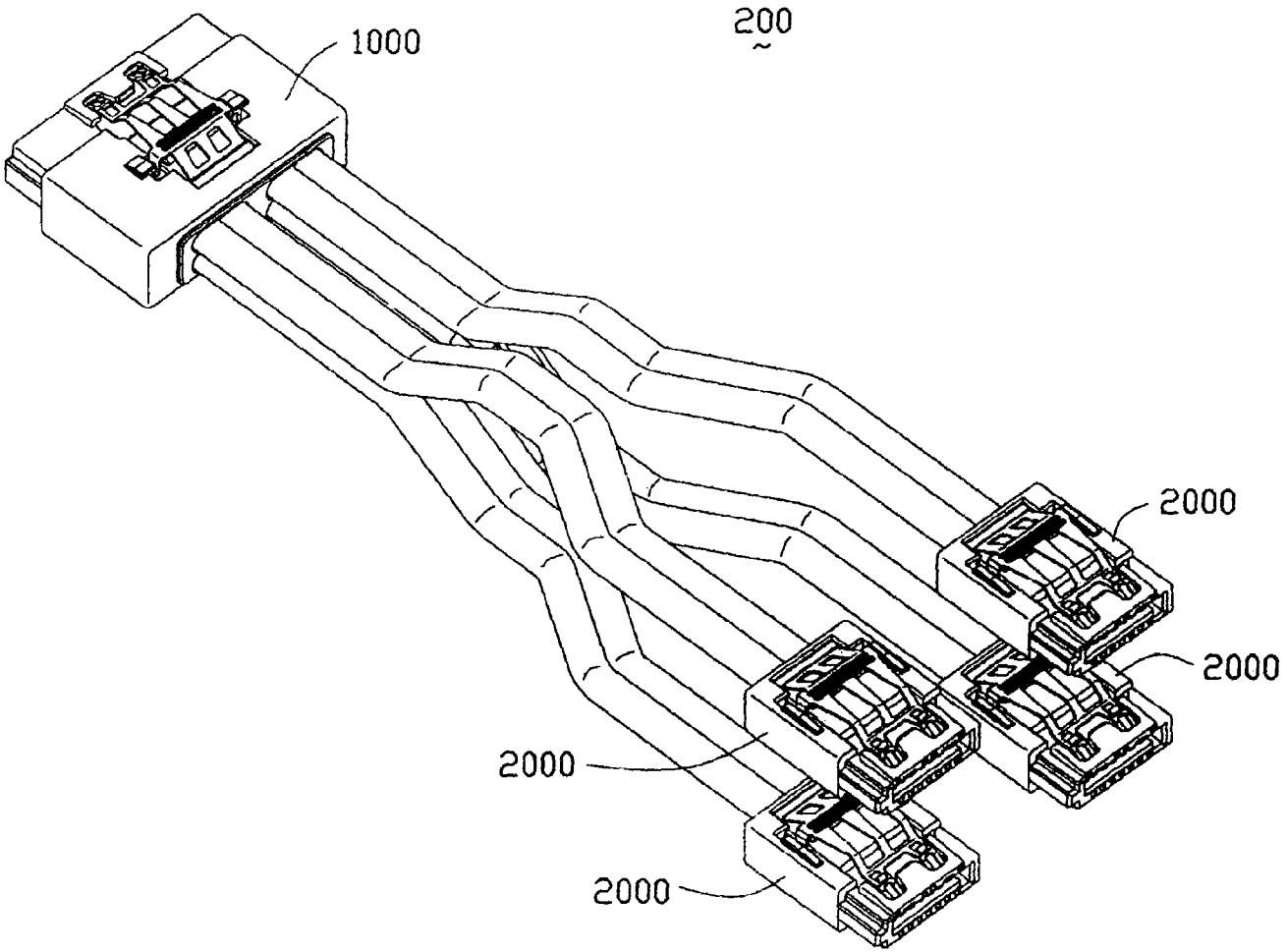
FIG. 8 is a view similar to FIG. 7, but taken from a different aspect.

FIGS. 7 and 8 illustrate a second embodiment of a cable assembly system 200 having a cable assembly 1000 according to the present invention in only one end of a set of cables and a plurality of single position seven pin connectors 2000 in the other end of the set of cables. The connector 2000 is detailedly disclosed in U.S. patent application Ser. No. 10/776,111 filed on Feb. 10, 2004 and entitled "CABLE END CONNECTOR ASSEMBLY HAVING LOCKING MEMBER", which is invented by the same inventor and assigned to the same assignee as this application. The disclosure of the related patent application is wholly incorporated herein by reference. Thus, the connector 2000 is given unnecessary details herein.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A cable assembly, comprising:

an electrical connector, comprising:

an insulative housing defining a receiving space; and a plurality of contacts received in the insulative housing;

a cable having a plurality of conductors each electrically connecting with a corresponding contact; and a cable spacer arranged to position the cable with respect to the insulative housing to prevent said cable from moving during over-molding; wherein said cable comprises plural groups of Serial ATA cables; wherein said cable spacer is attached to the cable and comprises a plurality of receiving cavities for receiving corresponding Serial ATA cables; wherein each Serial ATA cable comprises two differential conductor pairs, two pairs of grounding conductors each arranged at opposite sides of the differential conductor pair, and an outer jacket enclosing the differential conductor pairs and the grounding conductors.

2. The cable assembly as claimed in claim 1, wherein the cable spacer has a pair of position ribs disposed in top and bottom walls of each receiving cavity and each cable defines a pair of channels in middle portions of two opposite flat sides of the outer jacket along a lengthwise direction.

3. The cable assembly as claimed in claim 1, wherein the cable spacer has a pair of stopping posts extending forwardly from two opposite longitudinal ends of a front portion thereof.

4. The cable assembly as claimed in claim 1, wherein the cable spacer defines a groove in a middle portion of each of top and bottom walls thereof.

5. The cable assembly as claimed in claim 1, wherein the cable spacer has a pair of ear portions projecting outwardly from two opposite sides thereof.

6. The cable assembly as claimed in claim 1, further comprising a cover overmolded with a rear portion of the electrical connector, the cable spacer and a front portion of the cable.

7. The cable assembly as claimed in claim 6, further comprising a locking member being associated with at least one of said cover and said housing.

8. A cable assembly, comprising:

an electrical connector, comprising:

an insulative housing defining a receiving space; and a plurality of contacts received in the insulative housing;

a cable having a plurality of conductors each electrically connecting with a corresponding contact; and a cable spacer arranged to position the cable with respect to the insulative housing, wherein said cable comprises plural groups of Serial ATA cables, each Serial ATA cable comprising two differential conductor pairs, two pairs of grounding conductors each arranged at opposite sides of the differential conductor pair, and an outer jacket enclosing the differential conductor pairs and the grounding conductors;

wherein said cable spacer is attached to the cable and comprises a plurality of receiving cavity for receiving corresponding Serial ATA cables; and wherein the cable spacer has a pair of position ribs disposed in top and bottom walls of each receiving cavity and each cable defines a pair of channels in middle portions of two opposite flat sides of the outer jacket along a lengthwise direction.

9. A Serial ATA cable assembly, comprising:

an electrical connector, comprising:

an elongated insulative housing defining a receiving slot; and a plurality of contacts received in the insulative housing;

a plurality of cables each having a plurality of conductors electrically connecting with the corresponding contacts respectively; and a cable organizer attached to the housing to position the cable with respect to the insulative housing; wherein said cable organizer defining a matrix type receiving space essentially compliantly aligned with the housing in a front-to-back direction, said receiving space defining a plurality of units, and each of said units compliantly receiving a corresponding cable.

10. The cable assembly as claimed in claim 9, wherein said connector is equipped with a latch for locking with a complementary connector.

11. The cable assembly as claimed in claim 9, wherein said units are arranged in at least a 2×2 matrix type.

12. The cable assembly as claimed in claim 9, further comprising an insulative cover enclosing the cables and said organizer except a rearward direction.

13. The cable assembly as claimed in claim 12, wherein said organizer is rearward exposed to an exterior.

* * * * *